US010480785B2

(12) United States Patent
Stonis et al.

(10) Patent No.: US 10,480,785 B2
(45) Date of Patent: Nov. 19, 2019

(54) TORCH HAVING A ROTATABLE SAFETY CAP

(71) Applicant: WORTHINGTON TORCH, LLC, Columbus, OH (US)

(72) Inventors: Luke Christopher Stonis, Columbus, OH (US); Shea Michael Stewart, Columbus, OH (US); Cliff Ryan Walters, Westerville, OH (US); Donald James Staufenberg, Dublin, OH (US)

(73) Assignee: WORTHINGTON TORCH, LLC, Columbus, OH (US)

( * ) Notice: Subject to any disclaimer, the term of this patent is extended or adjusted under 35 U.S.C. 154(b) by 233 days.

(21) Appl. No.: 15/637,197

(22) Filed: Jun. 29, 2017

(65) Prior Publication Data

US 2018/0003383 A1 Jan. 4, 2018
US 2018/0149359 A9 May 31, 2018

Related U.S. Application Data

(60) Provisional application No. 62/356,192, filed on Jun. 29, 2016, provisional application No. 62/502,919, filed on May 8, 2017.

(51) Int. Cl.
*F23D 11/36* (2006.01)
*F23Q 2/16* (2006.01)
(Continued)

(52) U.S. Cl.
CPC ..... *F23Q 2/164* (2013.01); *F23D 14/465* (2013.01); *F23Q 2/287* (2013.01); *F23Q 2/32* (2013.01)

(58) Field of Classification Search
CPC ..... F23Q 2/164; F23Q 2/287; F23D 14/465; F23D 14/52; F23D 14/46; E05B 2047/0086; E05B 65/006; E05B 65/46; E05B 13/002; E05B 13/005; E05B 17/002; E05B 19/00; E05B 2047/002; E05B 2047/0024;
(Continued)

(56) References Cited

U.S. PATENT DOCUMENTS 4,348,172 A 9/1982 Miller
5,055,034 A 10/1991 Wang
(Continued)

OTHER PUBLICATIONS

International Search Report/Written Opinion dated Oct. 12, 2017, of corresponding International Application No. PCT/US2017/039920, filed Jun. 29, 2017 (9 pages).

*Primary Examiner* — Jason Lau
(74) *Attorney, Agent, or Firm* — Tucker Ellis LLP; Carlos Garritano

(57) ABSTRACT

A torch includes a body, a fuel tank and a microjet burner. The torch also includes an ignition button that is movable relative to the body between an upper position and a depressed position, and a cap assembly, which includes a lower cap and a safety cap rotatably coupled with the lower cap. The safety cap includes an ignition button guard, defines a flame portal, and is rotatable between a closed position and an armed position. When the safety cap is in the closed position, the ignition button guard is aligned with the ignition button and inhibits access to the ignition button, and the safety cap covers the microjet burner. When the safety cap is in the armed position, the flame portal is aligned with the microjet burner, and the ignition button guard is misaligned with the ignition button, and access to the ignition button is unobstructed.

12 Claims, 15 Drawing Sheets

(51) Int. Cl.
*F23D 14/46* (2006.01)
*F23Q 2/28* (2006.01)
*F23Q 2/32* (2006.01)

(58) Field of Classification Search
CPC ..... E05B 2047/0058; E05B 2047/0067; E05B 2047/0068; E05B 2047/0069; E05B 37/163; E05B 3/00; E05B 41/00; E05B 47/0004; E05B 47/0012; E05B 47/0607; E05B 47/0661; E05B 5/00; E05B 5/003; E05B 65/0014; E05B 65/461; E05B 65/52; E05B 7/00; E05B 83/18; F41A 3/66; F41A 17/46; F41A 19/10; F41A 19/16; F41A 3/68; F41A 9/65; F41A 9/67; F41A 9/70; F41A 9/83; F41C 23/04; F41C 23/22; F41C 23/02; F41C 23/14; F41C 23/20; F41C 27/00; F41C 33/06; A45C 13/262; A45C 2005/035; A45C 2013/265; A45C 2013/267; A45C 5/14
See application file for complete search history.

(56) References Cited

U.S. PATENT DOCUMENTS 5,092,764 A 3/1992 McDonough et al.
5,125,829 A 6/1992 McDonough et al.
5,224,854 A 7/1993 Ansquer
5,226,810 A 7/1993 Novinsky
5,308,240 A 5/1994 Lowenthal
5,417,571 A 5/1995 Kvalseth
5,435,719 A 7/1995 McDonough et al.
5,445,518 A 8/1995 McDonough et al.
5,454,713 A 10/1995 Lee
5,458,482 A 10/1995 Saito et al.
5,460,521 A 10/1995 Tsai
5,538,419 A 7/1996 Lin
5,580,239 A 12/1996 Jang
5,584,681 A 12/1996 Suzuki
5,628,627 A 5/1997 Fairbanks et al.
5,636,979 A 6/1997 McDonough et al.
5,645,415 A 7/1997 Hamel
5,829,965 A 11/1998 Rubaclava
5,934,894 A 8/1999 Cigler
6,065,959 A 5/2000 Tsai
6,077,069 A 6/2000 Fairbanks et al.
6,092,912 A 7/2000 Nelson
6,142,769 A 11/2000 Walker
6,152,725 A 11/2000 Lee
6,217,315 B1 4/2001 Mifune et al.
6,287,109 B1 9/2001 Hirota
D459,540 S 6/2002 Chen
D463,065 S 9/2002 Lee
D464,168 S 10/2002 Reynolds et al.
D464,463 S 10/2002 Smith
6,461,146 B1 10/2002 Hu
D467,684 S 12/2002 Lin
D468,482 S 1/2003 Lin
6,540,506 B1 4/2003 Li
6,589,045 B2 7/2003 Xu
6,592,362 B2 7/2003 Fisher
6,612,832 B1 9/2003 Huang
6,632,082 B1 10/2003 Smith
6,648,630 B2 11/2003 Tse
D483,519 S 12/2003 Liu et al.
6,655,953 B1 12/2003 Bengoa
6,659,763 B2 12/2003 Fisher
6,699,033 B2 3/2004 Xu
6,726,470 B1 4/2004 Meister
D492,061 S 6/2004 Reynolds
D492,064 S 6/2004 Fritz
6,755,642 B2 6/2004 Zhang
D499,508 S 12/2004 Park
6,827,572 B2 12/2004 Wong
D501,273 S 1/2005 Kwok
D502,567 S 3/2005 Xu
D504,975 S 5/2005 Xu
D509,318 S 9/2005 Poinstingl et al.
D509,622 S 9/2005 Smith
D515,731 S 2/2006 Smith
6,997,702 B1 2/2006 Chen
D528,245 S 9/2006 Smith
D528,247 S 9/2006 Smith
D529,225 S 9/2006 Rich
7,147,463 B2 12/2006 Wong
7,223,097 B2 5/2007 Perez
D553,290 S 10/2007 Smith
D553,792 S 10/2007 Smith
D556,376 S 11/2007 Smith
7,361,013 B2 4/2008 Xu
D587,399 S 2/2009 Praudel et al.
D588,740 S 3/2009 Maruyama
7,563,094 B2 7/2009 Yang
7,614,874 B2 11/2009 Mochizuki
7,637,736 B1 12/2009 Yang
7,682,148 B2 3/2010 Mochizuki
7,695,274 B2 4/2010 Caruso, II
7,708,554 B2 5/2010 Tsai
7,748,977 B2 7/2010 Mochizuki et al.
7,914,281 B2 3/2011 Tsai
8,449,291 B2 5/2013 Tsai
D691,008 S 10/2013 Watson
2001/0053504 A1 12/2001 Lu
2003/0062055 A1 4/2003 Park
2006/0073431 A1 4/2006 Brown
2007/0281262 A1 12/2007 Johnston et al.
2015/0064633 A1 3/2015 Dominguez
2016/0018108 A1 1/2016 Rahbar

TORCH HAVING A ROTATABLE SAFETY CAP

CROSS-REFERENCE TO RELATED APPLICATIONS

The present invention claims the benefit of U.S. Provisional Application 62/502,919, filed May 8, 2017, and U.S. Provisional Application 62/356,192, filed Jun. 29, 2016, the disclosures of which are incorporated by reference.

TECHNICAL FIELD

This application relates generally to portable fuel torches.

BACKGROUND OF THE INVENTION

Known hand-held, gas-burning devices include those that incorporate child-safety features to at least inhibit inadvertent ignition of the gas-burning device, for example, by a child. Known lighters include those having an upper cap, or cover, which can be "flipped" open to use the lighter, but does not automatically return to the non-use, closed position.

SUMMARY OF THE INVENTION

According to one embodiment, a torch includes a body and a fuel tank. The body defines an interior chamber and the fuel tank defines a fuel reservoir. The torch also includes a microjet burner, which is supported by the body and defines a fuel discharge passage. The torch further includes a piezoelectric igniter and an ignition button. The ignition button is movable relative to the body between an upper, neutral position, and a depressed, ignition position. The torch also includes a cap assembly, which includes a lower cap connected to the body, and an upper safety cap rotatably coupled with the lower cap. The fuel reservoir is in selective fluid communication with the fuel discharge passage of the microjet burner. A portion of each of the fuel tank, the microjet burner, the piezoelectric igniter and the ignition button is disposed within the interior chamber. The safety cap includes an ignition button guard extending from a periphery of the safety cap, and has an aperture defined by a flame portal. The safety cap is rotatable between a closed position and an armed position. When the safety cap is in the closed position, the extending ignition button guard is vertically disposed over and aligned with the ignition button, to inhibit digit (finger or thumb) access to the ignition button, for depressing the ignition button, and a portion of an upper or top wall of the safety cap is vertically disposed over and covers the microjet burner. When the safety cap is in the armed position, the flame portal has been rotated into a position vertically disposed over and aligned with the microjet burner, and the ignition button guard has been rotated to a position misaligned with the ignition button, and access to the ignition button is unobstructed.

BRIEF DESCRIPTION OF THE DRAWINGS

Various embodiments of a torch will become better understood with regards to the following description, appended claims and accompanying drawings wherein:

DETAILED DESCRIPTION OF THE INVENTION

In one application, a torch can be advantageously used by campers to start campfires, and for a variety of other uses and activities. The torch can provide more robust combustion power in a durable, compact form that permits a camper or other user to position a jet flame at any angle during use, even in windy conditions.

Figure 4:
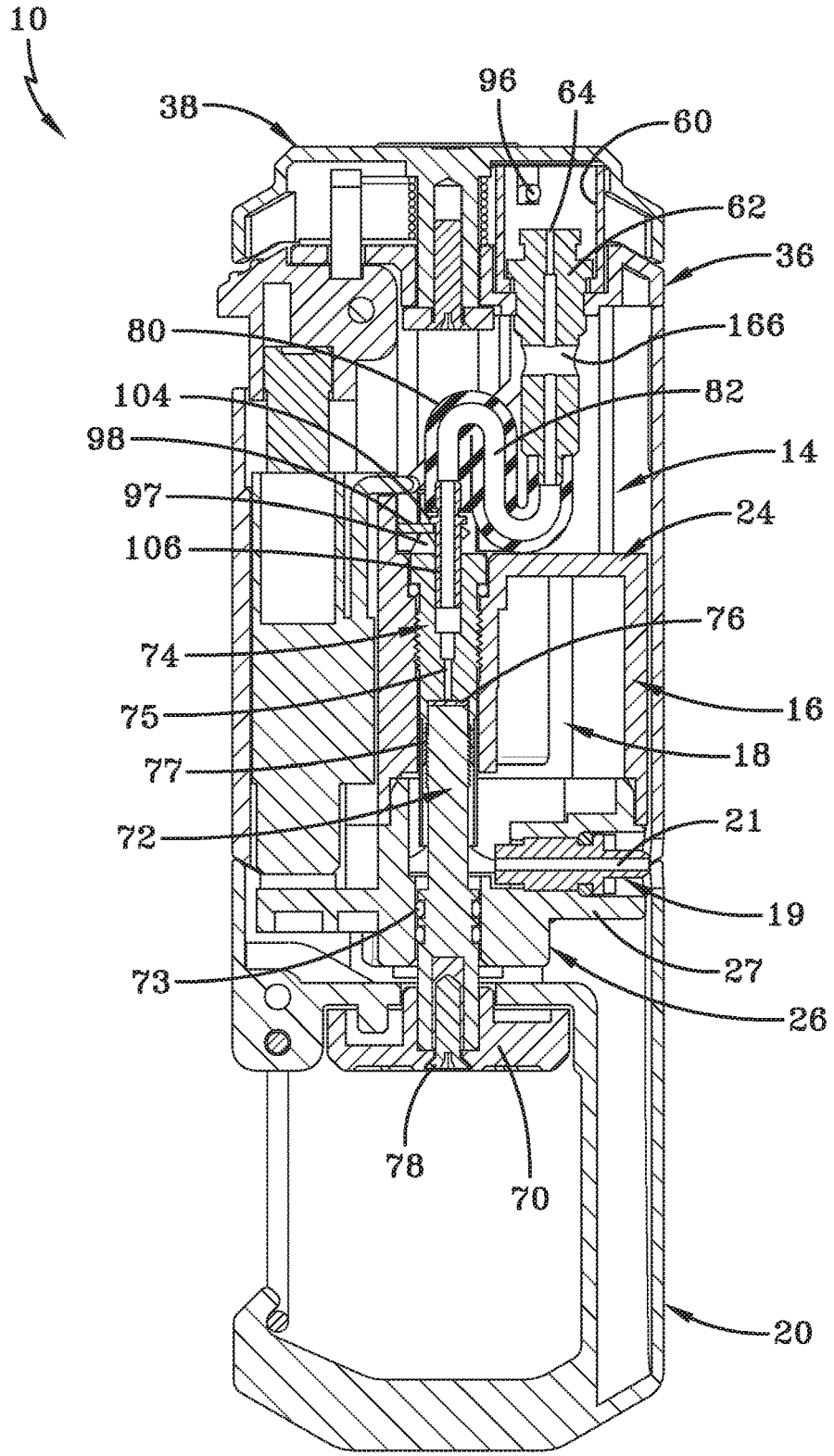
FIG. 4 is a front elevation view of the torch of FIG. 1.

FIGS. 1-4 illustrate a torch 10 that includes a fuel delivery system that includes a fuel tank 16, a fuel flow adjustment cap 70, a throttling valve stem 72, shown in FIG. 4, a fuel outlet valve 74, shown in FIG. 4, and a microjet burner 62.

The torch 10 also includes an outer body 12 that confines the other components of the torch, and has air inlet apertures 66 and one or more air filter media 69 for filtering the inlet air used in the fuel combustion.

The torch 10 also includes an ignition system that includes a piezoelectric igniter 88, an ignition button 90, and an ignition wire 95.

The torch 10 also includes a safety system, for preventing inadvertent ignition of the fuel, for example, by a child. The safety cap system includes a base cap 36, a rotatable safety cap 38, a safety cap return spring 130, and a spring release member 120 attached to the ignition button 90. When not in use, the torch is configured in a first, inactive or default configuration, in which a rotatable safety cap is in a closed or blocking position that at least inhibits access to an ignition button, and reduces the likelihood of an inadvertent ignition of the torch.

In a second, armed configuration, the safety cap has been rotated away from its closed position and is in an armed position, to uncover and expose the ignition button, and to provide unobstructed access to the ignition button, where subsequent depressing the ignition button initiates and delivers fuel flow, and effects flame ignition.

In an alternative embodiment, the torch 10 can include a utility feature, illustrated as a carabiner clip 20.

The Fuel Delivery System

The body 12 defines an interior chamber 14, and confines the fuel tank 16, that defines a fuel reservoir 18. The fuel tank 16 comprises an upper tank portion 24 with a peripheral edge wall sealingly joined along a peripheral edge wall of a lower tank portion 26. In one embodiment, the fuel tank 16 can be made of plastic, e.g., nylon, and the upper tank portion 24 can be sonic welded to the lower tank portion 26. The body 12 can be made as a unitary structure, and the fuel tank 16 can be slidingly and frictionally engaged within the body 12 during assembly and disassembly of torch 10. The upper tank portion 24 can be disposed within the interior chamber 14 and the lower tank portion 26 of fuel tank 16 can protrude from the bottom end of the body 12. Torch 10 can include a fuel fill port 19 threaded into a hollow boss 27 of the lower portion 26 of fuel tank 16 to define a sealable fuel inlet passage 21 in fluid communication with the fuel reservoir 18. To add fuel to the tank 16, the fuel inlet passage 21 can be placed into selective fluid communication with an interior chamber of a source of fuel, for example, an interior chamber of a tank or cylinder containing a hydrocarbon fuel, e.g., butane. Body 12 can also have an aperture that defines a fuel window 17, for example, an elongated or oval-shaped aperture, adjacent to and along a side wall of the fuel tank 16, to facilitate observing and determining the amount of fuel remaining within the fuel tank reservoir 18. The fuel tank 16 can be made of a translucent or transparent material, such as a fuel-inert plastic or even glass. The fuel tank 16 can also include a polished, reflective interior surface (not shown) within the fuel reservoir 18, which can facilitate observing the fuel level through a translucent material of the fuel tank 16.

Figure 1:
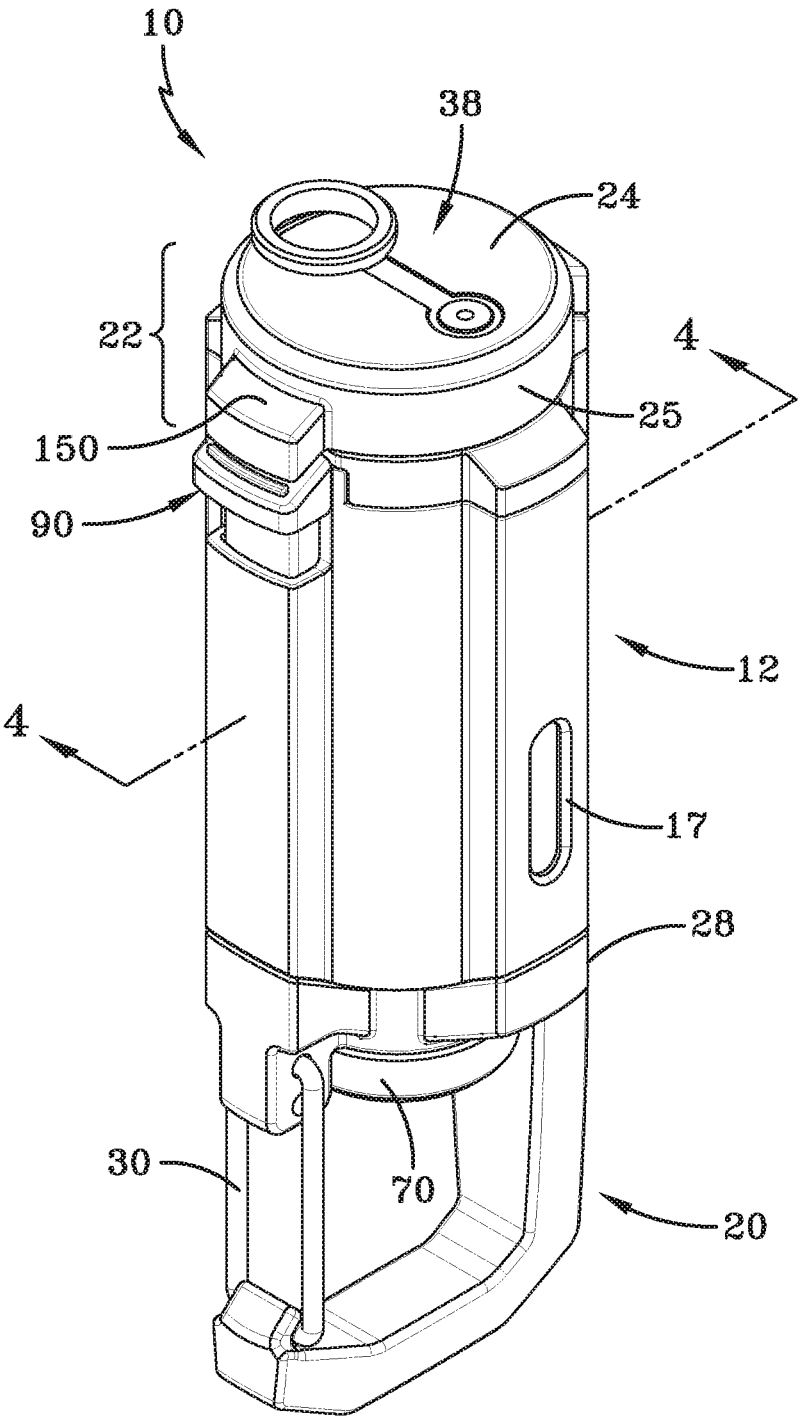
FIG. 1 is a perspective view of a torch according to the invention, with the torch depicted in an inactive, default configuration, with a safety cap disposed in a closed position, and an ignition button in a neutral position.
Figure 2:
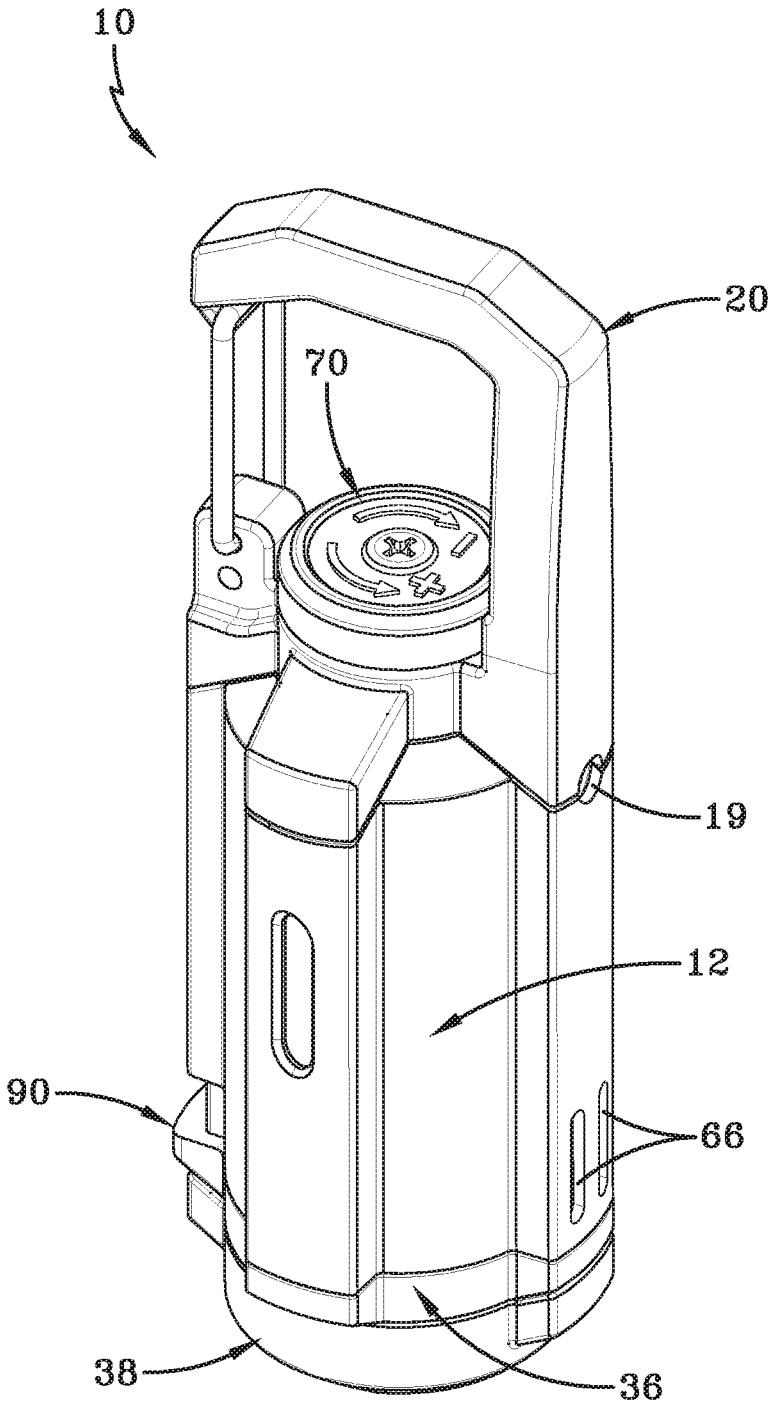
FIG. 2 is the torch of FIG. 1, in an inverted orientation.
Figure 3:
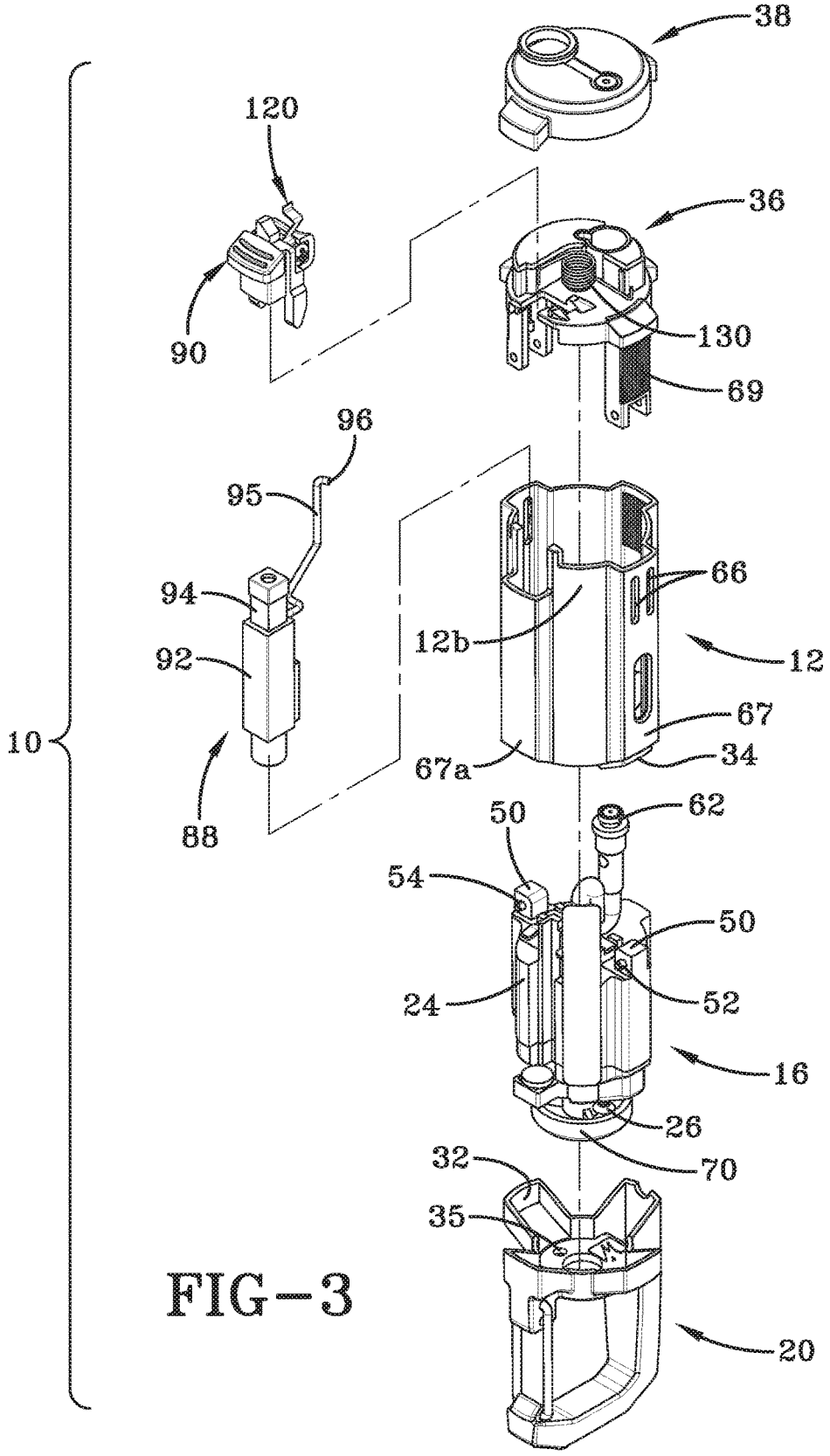
FIG. 3 is an exploded view of the torch of FIG. 1.
Figure 6:
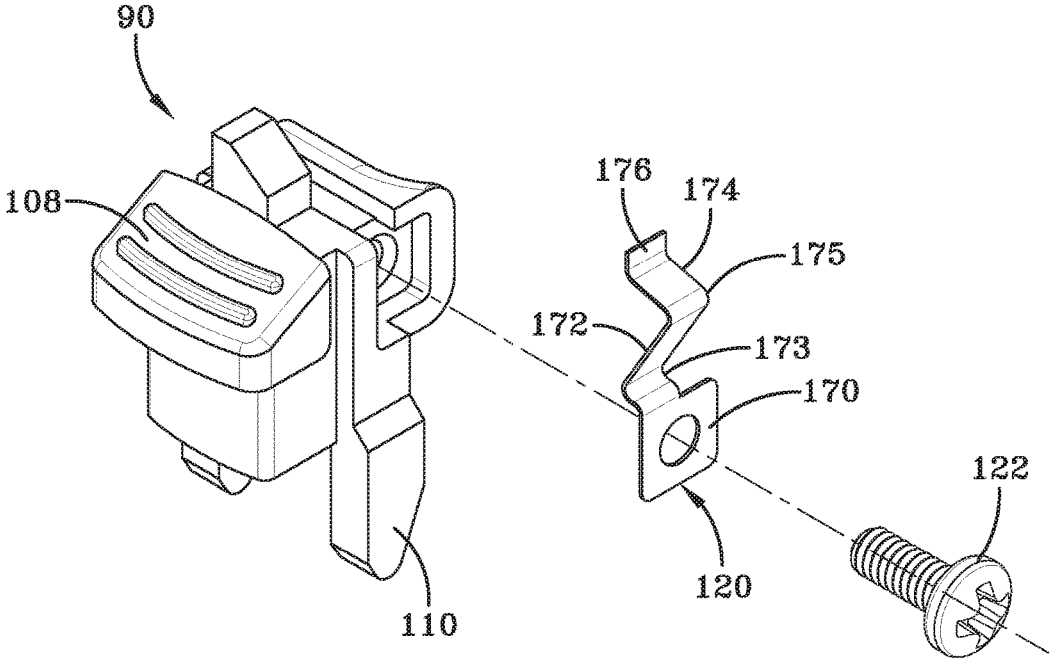
FIG. 6 is detailed view of an ignition button used in the torch of FIG. 1.
Figure 7:
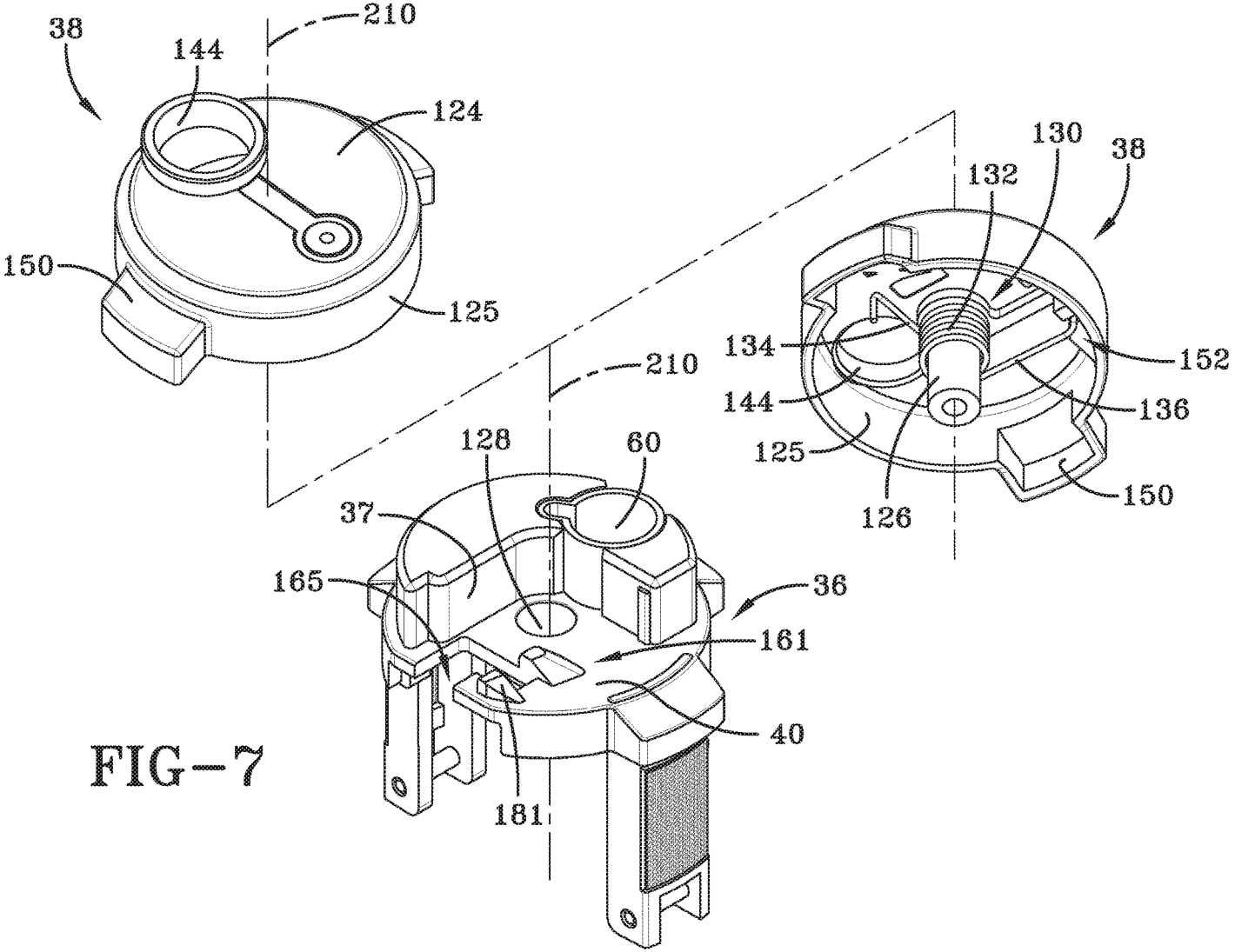
FIG. 7 is a perspective view of the cap assembly with a safety cap in a closed rotated position.

The torch 10 includes a cap assembly 22 that includes a lower base cap 36, and an upper safety cap 38 that is positioned over and coupled rotatably to the base cap 36. The safety cap 38 can be selectively rotated relative to the base cap 36 between a closed position as shown in FIGS. 1 and 6, and an armed position as shown in FIGS. 2 and 7. The lower cap 36 includes a base 40 and a platform 42 that can be integral with the base 40 and can extend above base 40 to define a sweep area of the base 40.

Torch device 10 includes a fuel flow adjustment cap 70 threadedly attached into a mating threaded bore in a lower end of a lower elongate throttle valve member 72 with a fastener 78, for rotation relative to the fuel tank 16 and body 12, an upper fuel outlet valve 74, and a porous compressible member 76 disposed between the lower elongate member 72 and the upper fuel outlet valve 74. The porous compressible member 76 can be a sponge, porous, resilient material, or other sponge-like material. Two or more annular seals 73 provide a fuel fluid seal between the lower elongate member 72 and the lower portion 26 of fuel tank 16. The mating threads 77 of the lower, elongate member 72 and the upper, fuel outlet valve 74 are sufficiently loose to allow fuel liquid and or fuel vapor to pass from the reservoir of the fuel tank 16, through the annular threads 77, into the porous member 76. Fuel from the porous member 76 can flow into the upper fuel outlet valve 74, which has a valve outlet passage 75 in fluid communication with a plunger 106, which can be manipulated by an igniter fork 98 through operation of the ignition button 90, as described herein after, for selectively discharging fuel from the fuel tank 16 to valve outlet passage 75. A conduit 80 defines a conduit flow passage 82 in the fluid communication between the valve outlet passage 75 and the fuel discharge passage 64 of the microjet burner(s) 62.

The fuel flow adjustment cap 70, the lower elongate member 72, the porous compressible member 76, and the upper fuel outlet valve 74, cooperate to control the fuel flow rate from the fuel reservoir 18 to the fuel discharge passage 64 of the microjet burner 62. During operation of torch 10, pressurized fuel flows from the fuel reservoir 18 through the annular, or generally annular, spaces between the mating threads 77 of the lower elongate member 72 and the upper fuel outlet valve 74, to the porous compressible member 76. The rotation of the fuel flow adjustment cap 70 controls the rate of fuel flow in the system. When the fuel flow adjustment cap 70 is rotated in a first direction, the lower elongate member 72 advances farther into the upper, fuel outlet valve 74, which compresses the porous compressible member 76 and effects a reduction in the porosity of the porous compressible member 76, which correspondingly reduces the fuel flow rate through the porous compressible member 76 and into the valve outlet passage 75. When the fuel flow adjustment cap 70 is rotated in an opposite direction, to withdraw it from the upper fuel outlet valve 74, the porous compressible member 76 can expand, effecting an increase in its porosity, and resulting in an increase in fuel flow rate through the porous, compressible member 76 and into the valve passage 75.

The Fuel Ignition System

Figure 5:
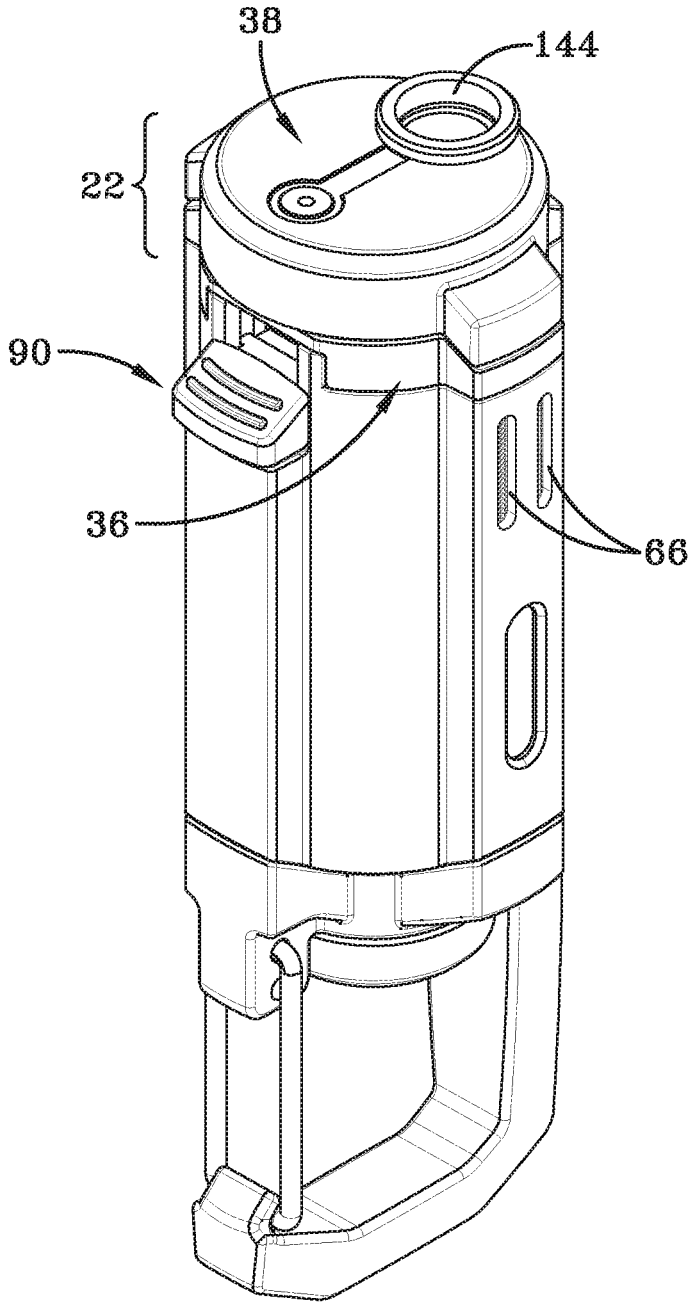
FIG. 5 is the torch of FIG. 1, with the safety cap disposed in an armed position, and the ignition button in a depressed, strike position.

The ignition system of the torch 10 includes a piezoelectric igniter 88 and the ignition button 90, shown in additional detail in FIG. 6. The piezoelectric igniter 88 can be a conventional device, and includes a body 92 and a piezoelectric plunger 94, which can be movable axially upward and downward, relative to the body 92. The ignition button 90 is movable between a raised neutral position shown in FIG. 1, and a depressed strike position shown in FIG. 5. When the ignition button 90 is pushed downwardly toward the depressed position, the ignition button 90 forces the piezo plunger 94 downwardly. When the ignition button 90 reaches a fully depressed position, the plunger 94 activates the piezoelectric igniter 88. A spring (not shown) disposed within the body 92 of the piezoelectric igniter 88, provides a means for biasing the plunger 94 and the ignition button 90 upwardly to the neutral position. After the force used to depress the ignition button 90 has been released, the compressed spring biases the piezoelectric plunger 94 to its neutral position.

Figure 8:
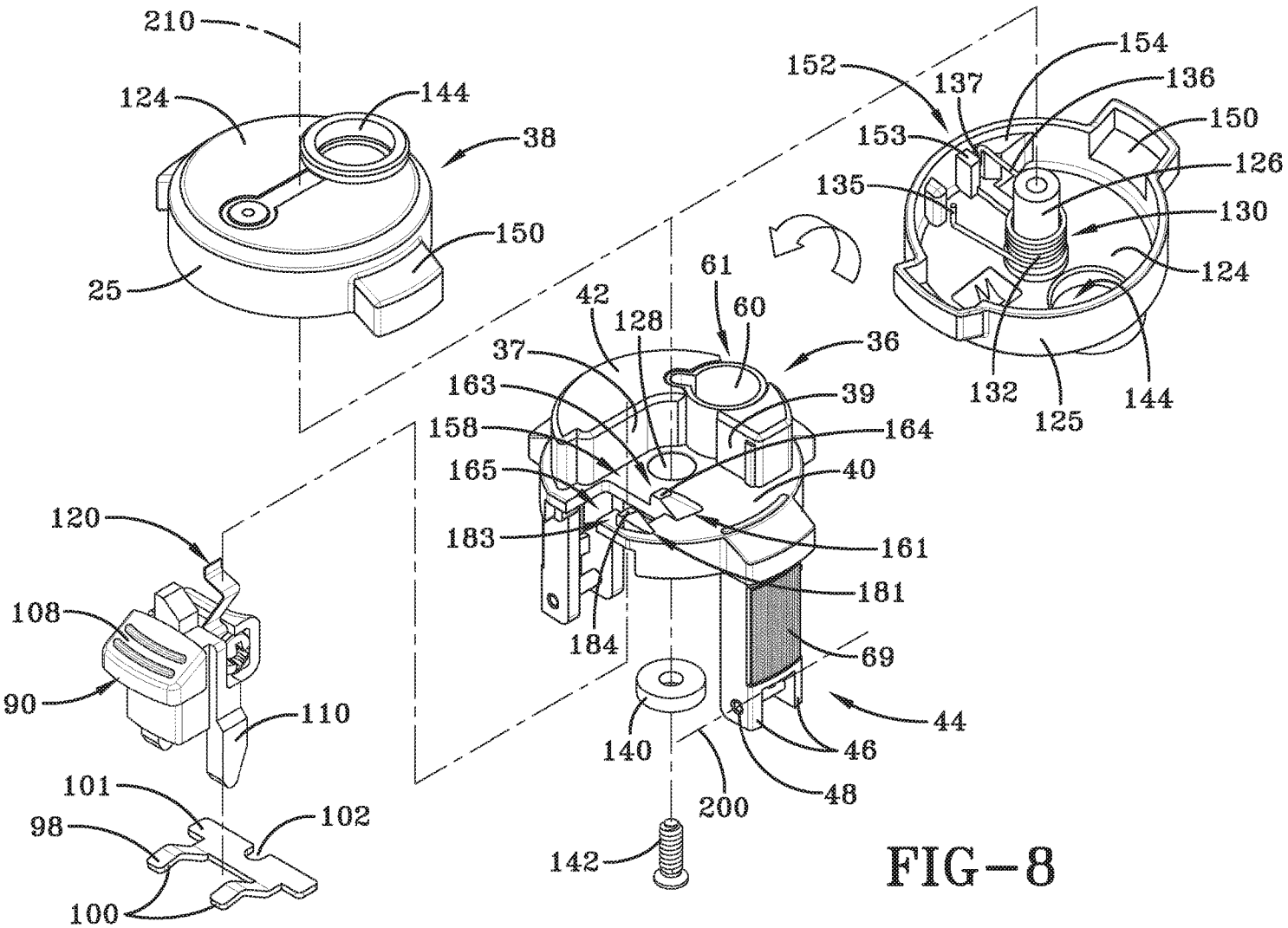
FIG. 8 is a perspective view of the cap assembly of FIG. 6 and the ignition button, with the safety cap in an armed rotated position.

The top surface of an upper portion 24 of fuel tank 16 can include a fulcrum 97, and torch 10 can include the ignition fork 98 that includes an intermediate portion that is disposed across the fulcrum 97, so that ignition fork 98 can pivot about the fulcrum 97. As illustrated in FIG. 8, a first end 99 of the ignition fork 98 includes a pair of spaced tines 100, and a second opposite end 101 has a notch 102 that is configured to receive a proximal end 104 of the fuel plunger 106 of the upper fuel outlet valve 74, as shown in FIG. 4. The ignition button 90 includes a pad 108 configured to receive an end of a finger or thumb of a user. The ignition button 90 can also include a pair of spaced and downwardly extending prongs 110. The prongs 110 can be spaced sufficiently to straddle an upper portion of the body 92 of the piezoelectric igniter 88. The pad 108 and prongs 110 of ignition button 90 can be made as a unitary structure.

When the torch 10 is in the inactive, default configuration, the ignition button 90 is in the upper or raised position. When the torch 10 is in the inactive, default configuration, the upper fuel outlet valve 74 is closed, and fuel is not provided to the fuel discharge passage 64. In this position, though the prongs 110 of the ignition button 90 may contact the tines 100 of the ignition fork 98 the second end 101 of the ignition fork 98 may not pivot upwardly at all, or may not pivot upwardly by a distance sufficient to raise the fuel plunger 106 and to discharge fuel from the upper fuel outlet valve 74.

The Cap Safety System

The cap safety system of the torch device 10 is now described. The safety interlock system includes the cap assembly 22, and the ignition button 90, including a spring release member 120. The base cap 36 can also include a plurality of downwardly extending members 44, and each of the members 44 can include a pair of distal prongs 46. Each prong 46 of each of the members 44, can define an aperture 48, and the apertures 48 can be aligned along an axis line 200. The distal prongs 46 can be spaced from one another on opposite sides of the base cap 36, and can be configured so that each pair of prongs 46 can engage a post 50 of an upper portion 24 the fuel tank 16, shown in FIG. 3, to secure the base cap 36 to the fuel tank 16. Each post 50 has an aperture 52 that when aligned with the apertures 48 of the respective pair of distal prongs 46, provides a through hole through which pins 54 can be inserted to connect the base cap 36 to the fuel tank 16. In the illustrated embodiment, the wall 12 includes four outer troughs 67 extending along the length and at 90° spacing around the wall 12. The ignition button 90 is shown disposed within one trough 67*a* of the troughs 67. The lower cap 36 includes three downwardly extending members 44, at 90° spacing around the wall 12 with the ignition button 90, which extend down into the three remaining troughs 67 and connect to an upper portion 24 of the fuel tank 16.

The base cap 36 can include an insulator 60 (FIG. 5) having a cylindrical shape that defines an interior space 61, and can be made of a ceramic material. The platform 42 of the lower cap 36 of cap assembly 22 can be configured with an opening to receive the insulator 60. The torch 10 also includes a microjet burner 62, which is disposed and fixed in position within the interior space 61 of the insulator 60. A lower portion of the microjet burner 62 extends through the base 40 into the interior chamber 14 of torch body 12, as shown in FIG. 4. An upper portion of the microjet burner 62 is disposed within the interior space 61. The microjet burner 62 includes a fuel discharge passage 64 from which fuel is ejected and ignited. The fuel reservoir 18 is in selective fluid communication with the fuel discharge passage 64.

As shown in FIGS. 7 and 8, the safety cap 38 includes a body comprising an upper surface wall 124, a cylindrical peripheral wall 125 that can be formed integrally with the upper surface wall 124, and a pivot stem 126 extending downwardly from the undersurface of the upper surface wall 124 along a central pivot axis 210. The base 40 of the base cap 36 has a central bore 128 configured to receive the pivot stem 126 when the safety cap 38 is positioned onto the base cap 36. A torsion spring 130 is disposed over the pivot stem 126, comprising a coiled wire portion 132, an upper spring leg 134 extending away from one end of the coiled wire portion 132, and a lower spring leg 136 extending away from the other end of the coiled wire portion 132 The pivot stem 126 of the safety cap 38 extends through the center channel of the coiled wire portion 132, and down through the bore 128. The pivot stem 126 is configured to rotate within the bore 128, allowing the safety cap 38 to rotate between its closed position and armed position. The safety cap 38 can be retained within the bore 128 by well-known means, for example, a washer 140 and a fastener 142 threaded into a bore in the pivot stem 126 (FIG. 8). The washer 140 can have an outside diameter that can be greater than a diameter of the bore 128, such that the washer 140 can abut a bottom surface of the stem 126, and the base 40 of the lower cap 36, to prevent the safety cap 38 from moving axially upwardly away from the lower cap 36.

The safety cap 38 includes a flame portal 144 in or extending upwardly from the upper surface wall 124, defining an opening sufficiently large in diameter through which the torch's flame will project from the microjet burner 62. The flame portal 144 is disposed a same radial distance from the centerline 210 of the safety cap 38 as the microjet burner 62 is disposed from the centerline 210 of the base cap 36, so that when the safety cap 38 is rotated in registry with the base cap 36 to its armed position, the flame portal 144 aligns axially with the microjet burner 62. In alternative embodiments, the flame portal 144 can extend further upwardly, than is illustrated, from the upper surface of the upper surface wall 124 to its distal edge, to provide improved wind shielding, to sustain a flame in higher wind velocities, and improved stability for the emitted flame.

When the safety cap 38 in its closed position, the flame portal 144 is spaced circumferentially from, and not in axial alignment with, the microjet burner 62, such that a portion of the upper surface wall 124 of the safety cap 38 covers the microjet burner 62, to minimize ingress of debris and protect the microjet burner. The safety interlock system also includes a means for concealing the microjet burner(s) 62 while the safety cap 38 is in its closed position, and for exposing or revealing the microjet burner(s) 62 only while the safety cap 38 is in its armed position.

The safety cap 38 also includes an ignition button guard 150, which extends radially outwardly from the cylindrical, peripheral wall 125 of the safety cap 38. In the illustrated embodiment, a pair of ignition button guards 150 is disposed on diametrically opposite sides of the safety cap 38. The upper surface wall 124, the peripheral wall 125, the pivot stem 126, and the ignition button guard 150 can be made as a unitary structure. The safety cap system includes the ignition button guard 150 as a means for inhibiting or preventing the delivery of fuel to the microjet burner, and for inhibiting or preventing a sparking from the ignition system that could ignite a flow of fuel. The safety cap system inhibits or prevents depressing of the ignition button 90 unless the safety cap 38 is rotated away from its closed position, toward or to its armed position.

The ignition button guard 150 of the safety cap 38 provide a selective means for inhibiting or preventing a user from depressing the ignition button 90. When the torch device 10 is not in use and is in the inactive, default configuration, the ignition button 90 is in its raised neutral position, and the safety cap 38 is positioned in its closed position, with the one or more ignition button guard 150 circumferentially aligned directly above and over the ignition button 90. In this position, the ignition button guard 150 inhibit access to the pad 108 of the ignition button 90, and at least reduce the likelihood of an inadvertent ignition of torch 10, for example, by a child.

The Safety Cap Return Mechanism

The safety cap system also includes a means for automatically returning the safety cap 38 to its closed position, and concealing the microjet burner 62, when the depressing force is removed and the ignition button 90 returns to the neutral position. The safety cap 38 includes a pair of adjacent posts 153 and 154 extending from the undersurface of the upper surface wall 124, which define a spring-tip retaining slot 152. The upper spring leg 134 of the torsion spring 130 includes a down-turned tip 135 (shown "up-turned" with the "inverted" safety cap 38 of FIG. 5), and the lower spring leg 136 includes an up-turned tip 137 (shown "down-turned" with the "inverted" safety cap 38 of FIG. 5). The slot 152 in the safety cap 38 is configured to receive and capture at least an upper portion of the up-turned tip 137 of the lower spring leg 136 of the torsion spring 130. The upper spring leg 134 is biased by spring torsion against the neutral wall 37. With the safety cap 38 in its closed position, the torsion spring 130 exerts a torque force to bias the safety cap 38 towards the closed position. The neutral wall 37 and the slot 152 control torquing of the torsion spring 130 as the base cap 36 is rotated between its neutral or closed position, and its armed position. The up-turned tip 137 stabilizes the upper spring leg 134 against the neutral wall 37 of the base cap 36. The up-turned tip 137 of the lower spring leg 136 extends a distance into the slot 152 sufficient to stabilize the lower spring leg 136 within the slot 152 when the safety cap 38 is rotated from the closed position toward the armed position. The down-turned tip 135 and up-turned tip 137 also help to prevent the respective upper spring leg 134 and lower spring leg 136 from rotating axially along their respective length.

When the safety cap 38 is positioned over the base cap 36, with the up-turned tip 137 captured within the slot 152 between the posts 153 and 154, the lower spring leg 136 can be swept arcuately across the surface of the base 40 when the safety cap 38 is rotated between the closed position and the armed position. The lower base cap 36 includes a ramp post 161 extending upwardly from the base 40, which lies in the arcuate swept path of the lower spring leg 136. The ramp post 161 includes a sloped or inclined forward ramp surface 162, facing the sweep wall 39, which is angled upwardly from an upper surface of the base 40, and slopes upwardly while moving circumferentially from the sweep wall 39 toward the neutral wall 37 of the base cap 36. Ramp post 161 can also include a top surface 164, which can be generally parallel with the upper surface 158 of base 40, with the ramp surface 162 extending between the upper surface of the base 40 and the top surface 164 of the ramp post 161. Ramp post 161 also includes a rear blocking surface 163 disposed opposite the ramp surface 162 and extending downward and perpendicularly away from the top surface 164 of ramp post 161 to the upper surface of base 40.

Figure 9A:
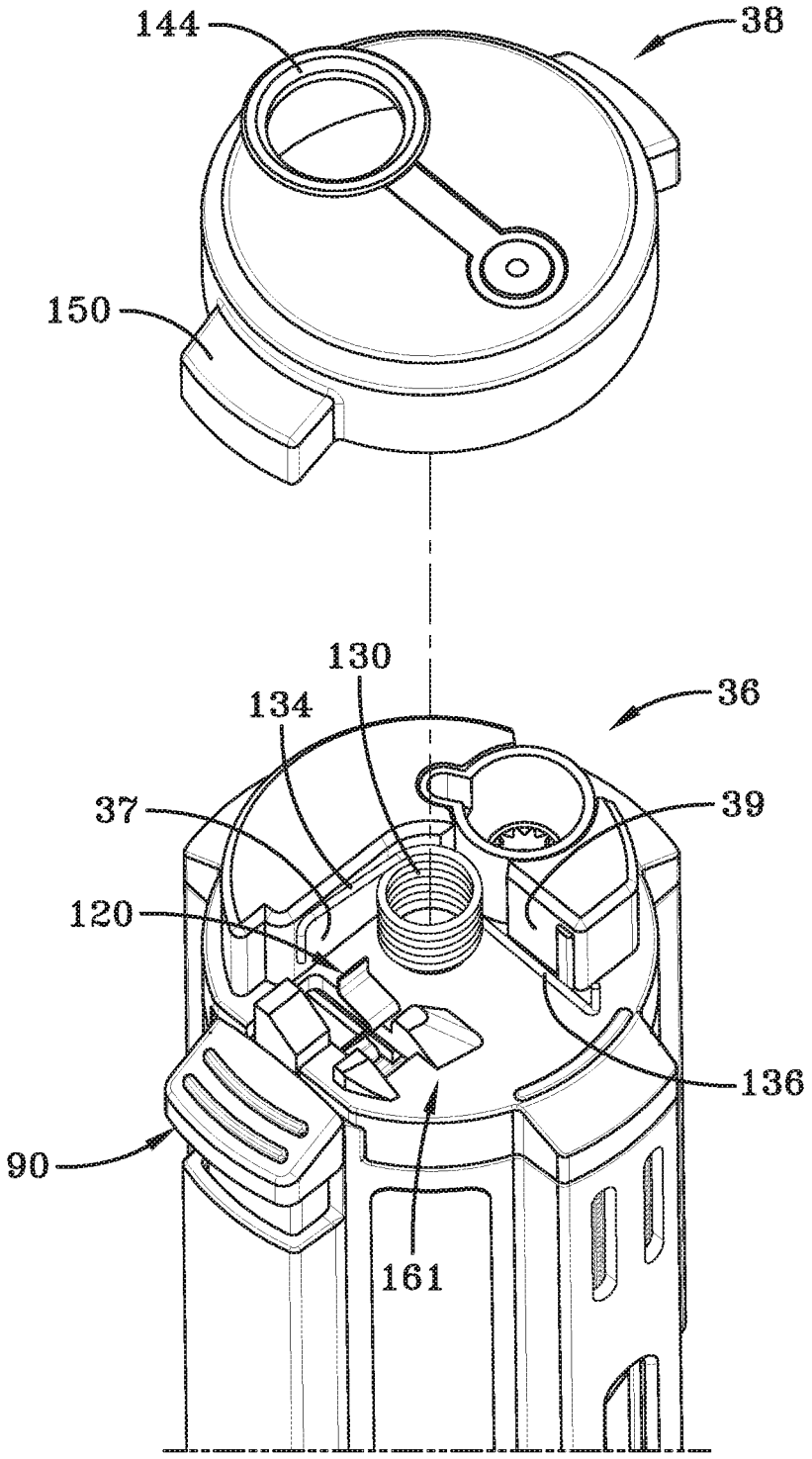
FIG. 9A is an exploded view of the cap assembly with the safety cap in a closed position, with the ignition button disposed in its neutral position.

The surfaces and ramps of the ramp post 161 interact with and control the axial (vertical) movement of the lower spring leg 136 of the torsion spring 130 as the safety cap 38 sweeps the lower spring leg 136 in its swept arc across the upper surface of the base 40 of the safety cap 38. FIG. 9A shows safety cap 38, base cap 36, and lower spring leg 136 of the torsion spring 130 in their neutral and closed positions. In this position, the tension spring 130 exerts a torque on the lower spring leg 136, which exerts a force against the sweep wall 39, and provide rotative resistance to movement of the safety cap 38 from its closed position.

Figure 9B:
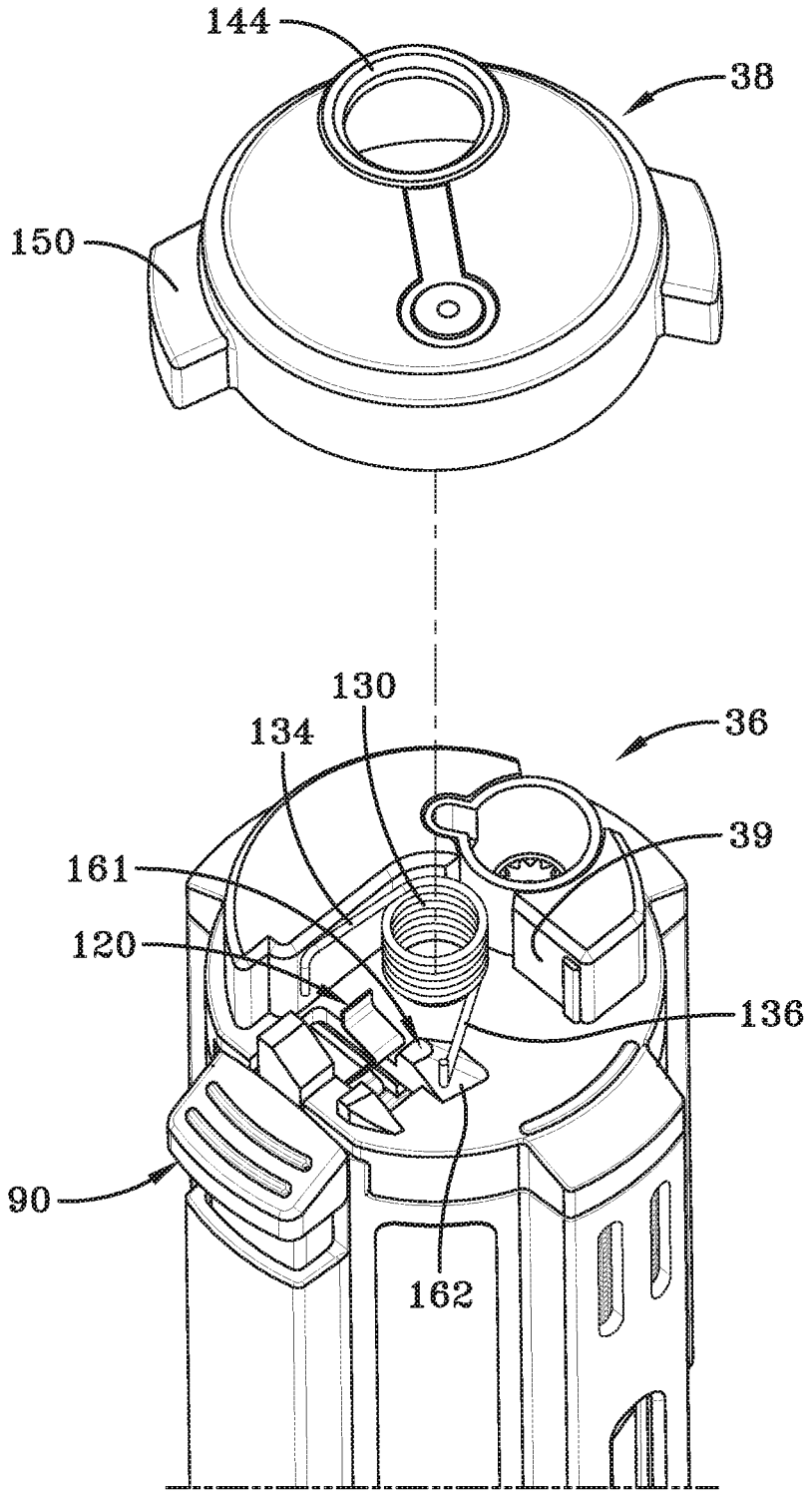
FIG. 9B is the cap assembly of FIG. 9A with the safety cap rotated from the closed position toward an armed position.
Figure 9C:
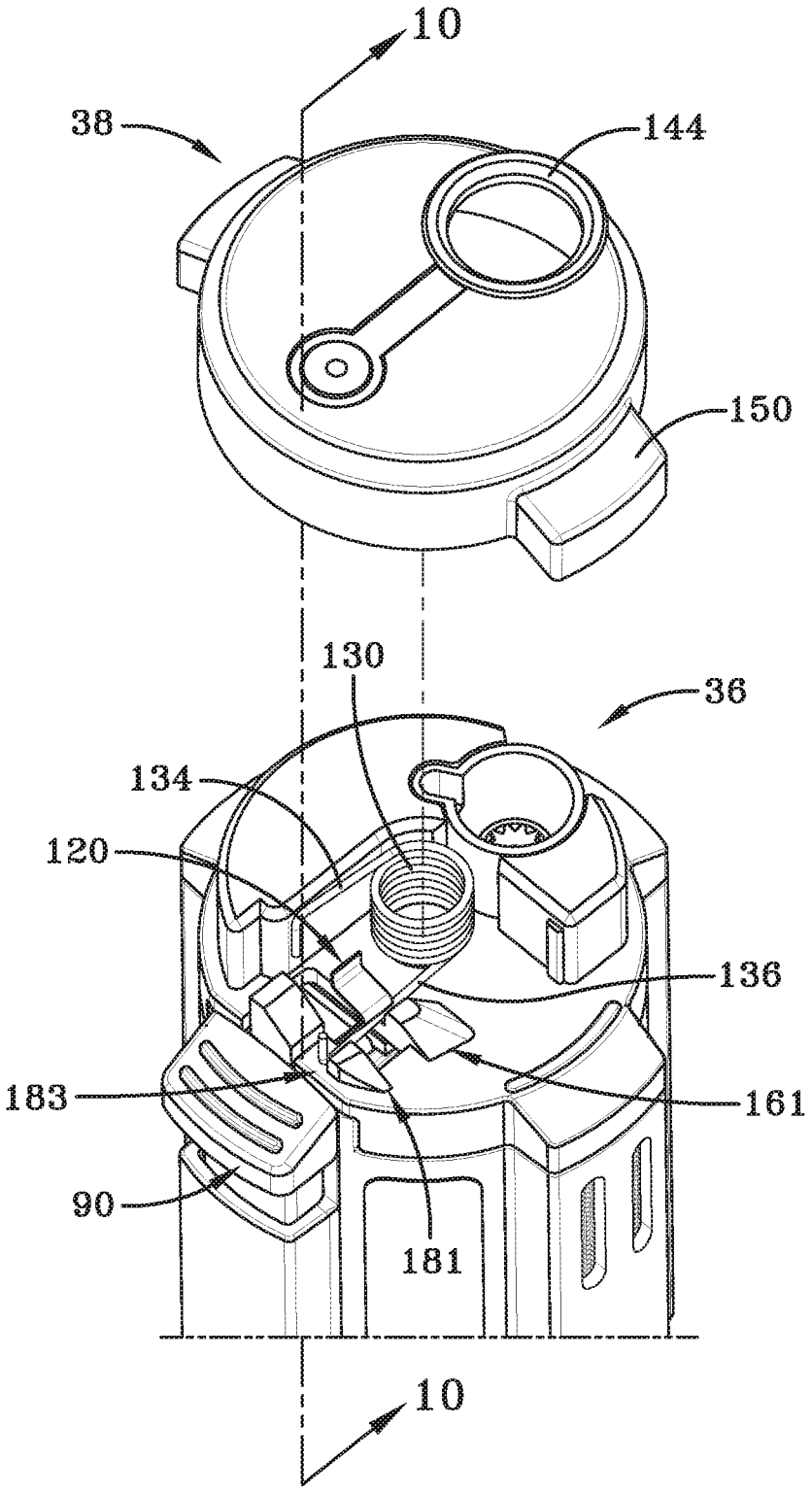
FIG. 9C is the cap assembly of FIG. 9A with the safety cap rotated to the armed position.

When the lower spring leg 136 is swept in the arc across the top surface of the base 40, retained within the slot 152 of safety cap 38 the lower spring leg 136 rides up the inclined surface 162 of the ramp post 161 as shown in FIG. 9B, and across the top 164. As the lower spring leg 136 is swept off the top 164, the lower spring leg 136 pushes the intermediate member 172 of the ignition spring release member 120 laterally away, and springs downward axially along the rear blocking surface 163 of the ramp post 161, to an armed position, as shown in FIG. 9C, where it becomes trapped from springing back along the arc path and returning to its neutral position. In the armed position, the up-turned tip 137 of the lower spring leg 136 remains captured in the slot 152 between the posts 153,154, preventing the safety cap 38 from being rotated back to its closed position. The safety cap 38 remains in the armed position, so long as the lower spring leg 136 remains trapped behind the rear blocking surface 163.

When the lower spring leg 136 of the torsion spring 130 snaps downward from the top 164 of the ramp post 161 to the trapped position behind a ramp post 161, either or both of the downward force of the lower spring leg 136 striking the base 40, and the snapping sound resulting therefrom, provide tactile and audible feedback to the user that the safety cap is locked into its armed position.

In the illustrated embodiment, the lower spring leg 136 can sweep in an arc angle of about 90°, corresponding to the rotative angle of the safety cap 38 (although the arc angle and the rotation of the safety cap 38 from neutral position to armed position can be either larger than or smaller than 90°). The force applied to the safety cap 38 to sweep the lower spring leg 136 to the armed position builds up torque in the coil, which biases the lower spring leg 136 to move back toward its neutral position. In order to return the safety cap 38 to its neutral position, a means is provided to raise the distal end of the lower spring leg 136 along the height of the rear blocking surface 163 and from behind the ramp post 161, to spring the lower spring leg 136 back to the neutral position, drawing with it the safety cap 38. The ignition button 90 include ignition spring release member 120 attached rigidly to the ignition button 90, e.g., with a screw fastener 122 as shown in FIG. 6, so that the ignition spring release member 120 can move upwardly and downwardly with the ignition button 90 as the ignition button 90 is depressed downwardly and released upwardly. When the ignition button 90 is in its upper, neutral position, the intermediate member 172 and upper lifting member 174 of the ignition spring release member 120 extend through a through opening 165 in the base 40 of the lower cap 36. As shown in FIG. 7, the through opening 165 extends through the base 40, and can have a rectangular shape in plan view, and is of a size sufficient for the ignition spring release member 120 of the ignition button 90 to pass down and up through the opening 165 when the ignition button 90 is depressed and released from its neutral raised position to the depressed strike position. The through opening 165 is disposed adjacent and radially outboard from the rear blocking surface 163 of the ramp post 161.

The ignition spring release member 120 is shown in more detail in FIG. 6. The ignition spring release member 120 includes a mount portion 170 having an aperture to accept the fastener 122 to attach ignition spring release member 120 to ignition button 90, such has a threaded screw into a threaded bore in the ignition button 90. The ignition spring release member 120 can include a spring body comprising a thin resilient plate that extends from the mount portion 170 at a flexing portion 173. The spring body includes an upwardly extending, intermediate member 172 that is inclined at an angle relative to vertical and away from the ignition button 90, and an upper lifting member 174 extending from a distal end of the intermediate member 172, angled back toward the ignition button 90, and configured to extend generally parallel with the upper surface 158 of base 40 in a non-deflected, unbiased orientation. An upturned distal end member 176 can extend from a distal end of the upper lifting member 174. The mount portion 170, intermediate member 172, upper lifting member 174, and distal end member 176 can be made as a unitary structure from a resilient sheet or plate material of plastic or spring steel. The intermediate member 172 is configured to flex slightly at the flexing portion 173 when a lateral force is applied to the intermediate member 172, and return when the force is released. The upper lifting member 174 is configured to flex minimally at its joint 175 when a vertical force is applied along the upper lifting member 174.

Figure 9D:
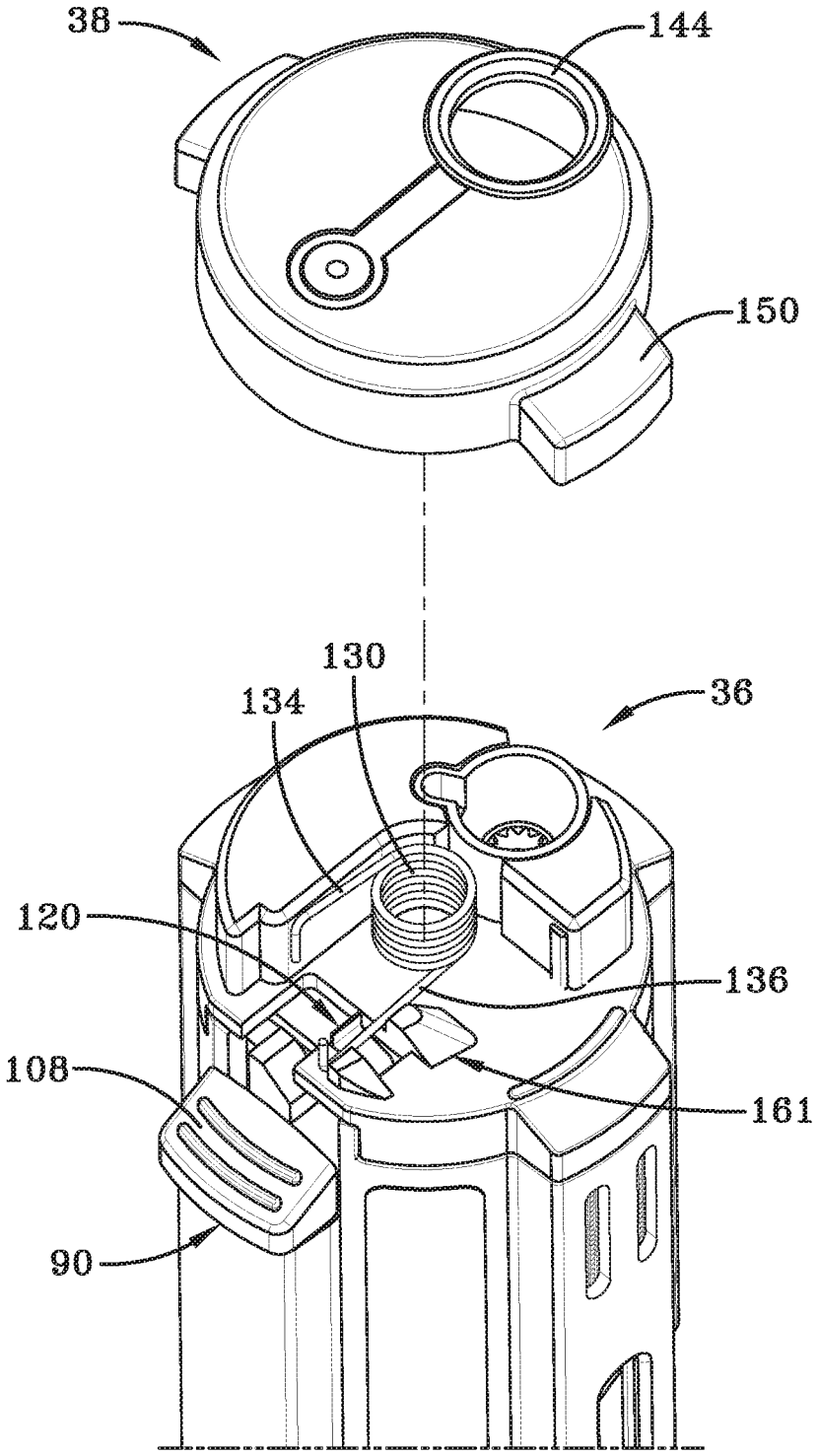
FIG. 9D is the cap assembly of FIG. 9C with the safety cap rotated to the armed position, and the ignition button depressed to the igniting position.
Figure 9E:
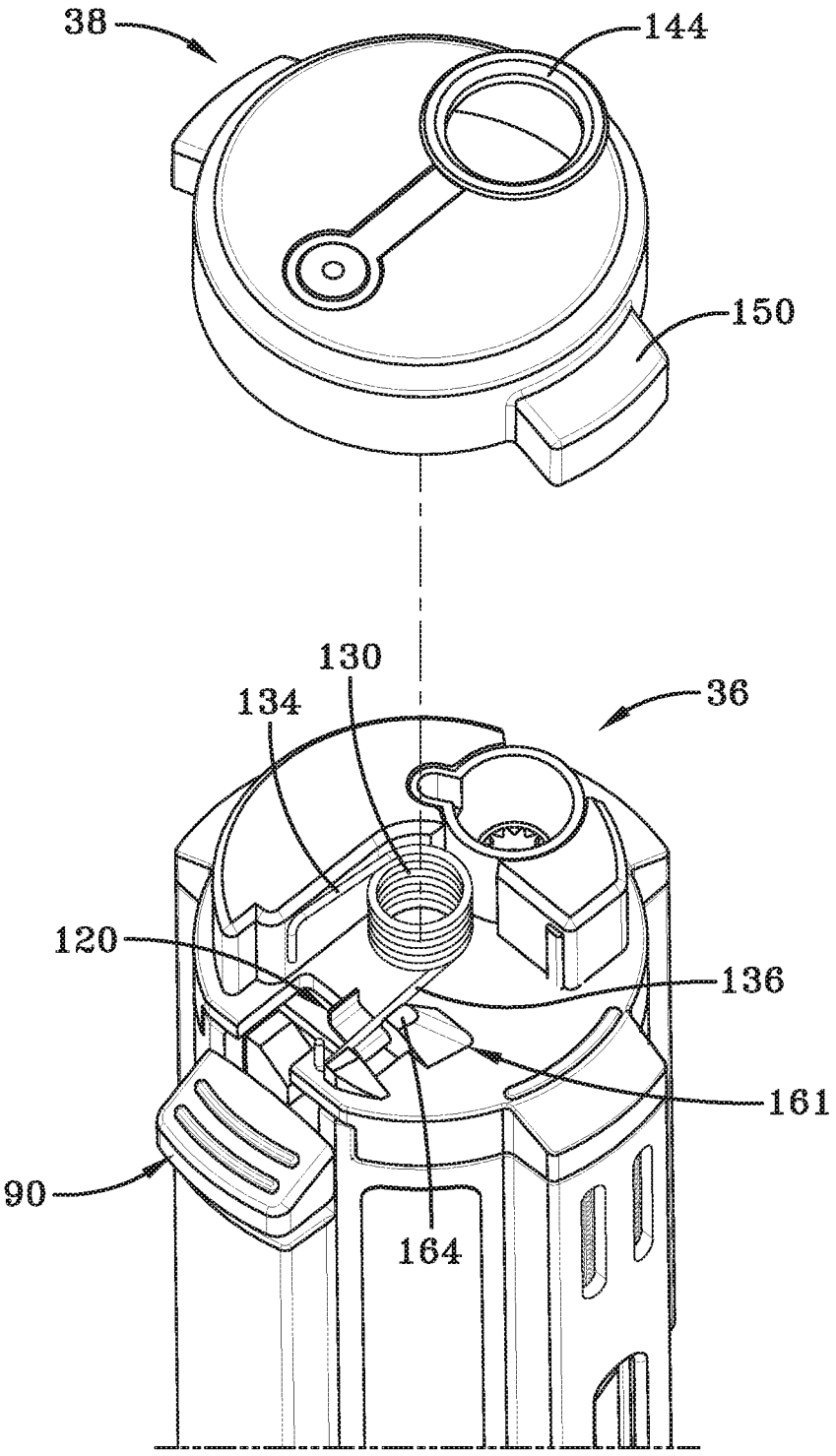
FIG. 9E is the cap assembly of FIG. 9D, with the ignition button being released to its neutral position.

The ignition spring release member 120 that extends upwardly from the body of the ignition button 90 provides the means for lifting or raising the swept and trapped lower spring leg 136 of the torsion spring 130 upward along the height of the rear blocking surface 163, and over the top 164 of the ramp post 161. As the upper lifting member 174 passes through the opening 165, it contacts a portion of the lower spring leg 136 disposed in its armed position against the base 40, that spans across the opening 165 as shown in FIG. 9D. As the ignition button 90 and ignition spring release member 120 continue rising, the upper lifting member 174 lifts up and raises the lower spring leg 136 to the top 164 of the ramp post 161, shown in FIG. 9E, where the coil of the torsion spring 130 swings the lower spring leg 136 back to its neutral position, as shown previously in FIG. 9A. Once the lower spring leg 136 clears the top 164, the wound coil of the torsion spring 130 unwinds and the biases lower spring leg 136 returns down the forward ramp surface 162, across the base 40 to the neutral position, while the up-turned tip 137 of the lower spring leg 136 rotates the safety cap 38 back to the closed position.

Figure 10:
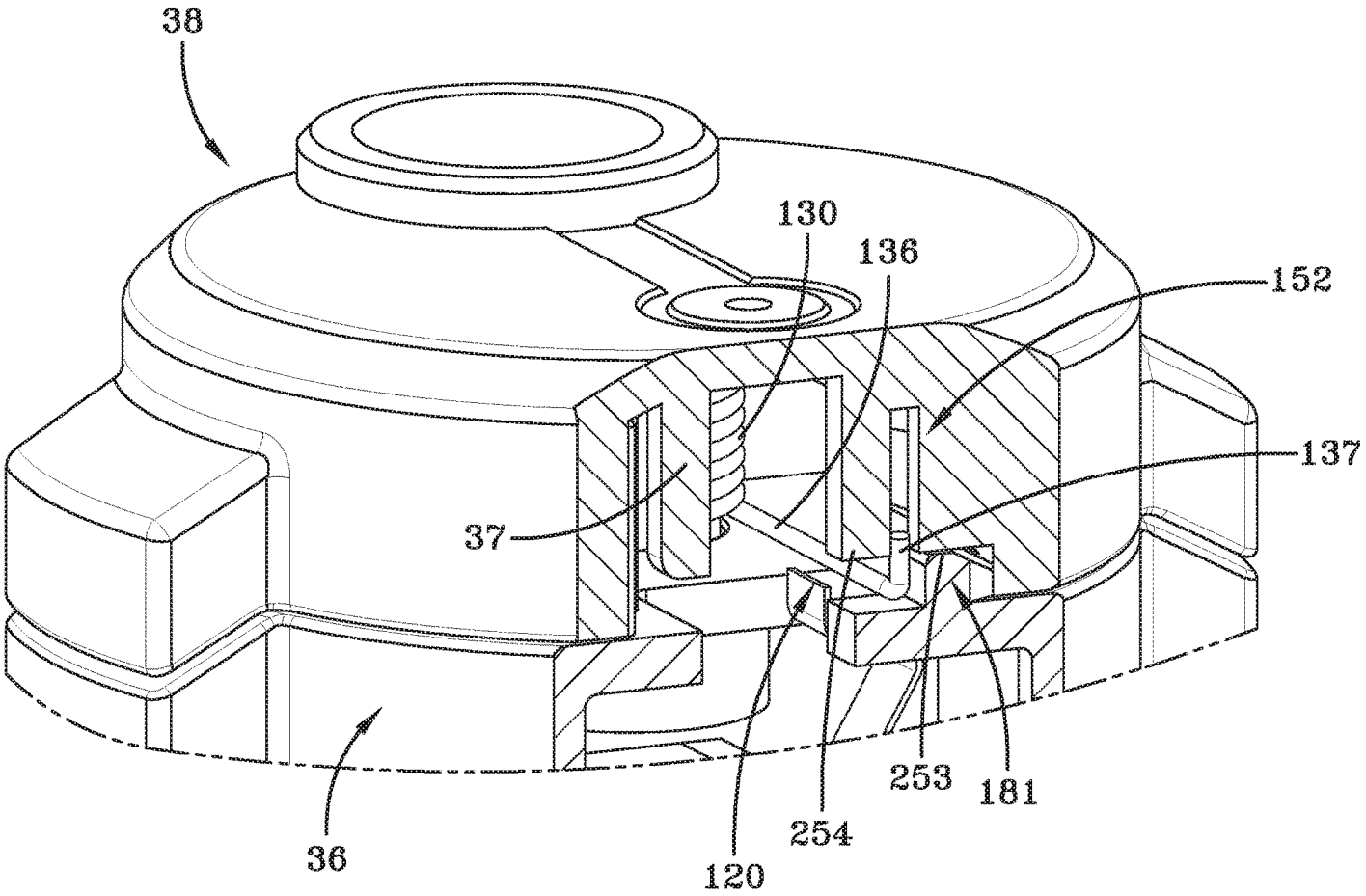
FIG. 10 is sectional view through the cap assembly of a torch, taken through line 10-10 of FIG. 9C.

As shown in FIG. 8 and FIG. 9C, the ramp post 161 is positioned proximate midpoint of the length of the lower spring leg 136, to provide anti-rotation movement by the lower spring leg 136, until the user releases the ignition button 90, causing the upper lifting member 174 to raise the lower spring leg 136 to the top 164 of the ramp post 161 and to swing back to its neutral position. Thus, so long at the user continues to depress the ignition button 90, the lower spring leg 136 remains trapped behind ramp post 161, with the up-turned tip 137 of the lower spring leg 136 captured within the slot 152 of the safety cap 38, disposed in its armed position. In case an inadvertent or accidental event where the user decides to manually grasp and counter-rotate the safety cap 38, while also firmly depressing the ignition button, the return rotation of the safety cap 38 will apply a counter-rotative lateral force upon the up-turned tip 137 and the distal end of the lower spring leg 136, while the proximal end of the lower spring leg 136 is prevented from counter rotation by the ramp post at its approximate midpoint. The counter rotation of the safety cap by the user may apply a counter-rotative lateral force on the up-turned tip 137 that is sufficient to bend the lower spring leg 136 around the ramp post 161 acting as a fulcrum, proximate its midpoint. In order to resist or prevent the inadvertent or accidental counter-rotation of the safety cap, while firmly depressing the ignition button, a second counter-rotation post 181 is provided on and extending upward from the base 40 of the lower base cap 36. The counter-rotation post 181 typically does not assist in the ramping up of the lower spring leg 136, though it top surface is typically flush with the top surface 164 of the ramp post 161. As shown in FIG. 10, the pair of adjacent posts 153 and 154 of the safety cap 38 are configured to extend downward only sufficiently to retain the up-turned tip 137 of the lower spring leg 136, with their distal ends 253 and 254 sufficiently clearing across the top surface 184 of the counter-rotation post 181.

It can be understood that in other embodiments, the safety cap can be locked in the armed position, using other structures and means of different configuration. For example, the ramp post can be replaced by a ratchet device, that allows the lower spring leg to ratchet past a sloped end of a pivoting element, which pivots out of the sweeping path of the lower spring leg, and then biases back into position to capture the lower spring leg in the armed position. The lower spring leg can be released from the armed position by manually pivoting the pivoting element out of the sweeping path, to allow the lower spring leg to sweep back to its neutral position.

When a user, for example a camper, wishes to use torch device 10, for example to light a campfire, the user must first rotate (for example, clockwise) the safety cap 38 to the armed position. At the armed rotated position, the lower spring leg 136 of the torsion spring 130 becomes trapped behind the ramp post 161, the ignition button 90 is uncovered by the ignition button guard 150, and the interior space 61 aligns with the microjet burner 62. The user then depresses the ignition button 90 to both start the flow of fuel to the microjet(s), and to strike the piezoelectric igniter 88 and emit a spark at ignition wire 96, and the microjet burner 62 emits a flame from the torch 10 through the interior space 61. The flame remains so long as the user continues to hold the ignition button 90 in the depressed position.

When the ignition button 90 is released (by the user), the fuel flow is cut off and the flame extinguishes, and the lower spring leg 136 is released from its trapped position, swinging the safety cap 38 back to its closed position where the ignition button guard 150 again aligns with and blocks the ignition button 90, and the microjet burner 62 are covered by the upper surface wall 124. The upward force exerted on the ignition fork 98 by the prongs 110 of the ignition button 90 is released, and the fuel outlet valve 74 returns to its closed position to shutoff the fuel flow.

In another embodiment of the invention, the body 12 of the torch device 120 can have one or more air inlet apertures 66, which are in fluid communication with the interior chamber 14 of the body 12. The interior chamber 14 is, in turn, in fluid communication with the interior space 61 with the insulator 60, to deliver combustion air for burning the fuel from the microjet burners. In the illustrated embodiment, the body 12 includes an upper portion 12*b* of the wall 12 that is disposed or extends above an upper portion of the upper tank portion 24 the fuel tank 16. The upper portion 12*b* of the wall 12 has a one or more, and preferably a plurality, of air inlet apertures 66, in one portion or face of the torch body 12. In the illustrated embodiments, the wall 12 includes four outer troughs 67 extending along the length and at 90° spacing around the wall 12. The ignition button 90 is disposed within one trough 67*a* of the troughs 67, while in each of the remaining three troughs 67, in the upper portion 12*b* of the wall 12, a pair of air inlet apertures 66 is formed. In other embodiments, body 12 can define other numbers of air inlet apertures 66, the one or more air inlet apertures 66 can be disposed circumferentially in other portions or faces of the torch body. An advantage of placing the one or more air inlets 66 into circumferentially different positions or faces is to ensure that at least one of the air inlets 66 is open and unobstructed by the hand or fingers of a user while the user is grasping the torch tool during use of the fuel torch. The air inlet apertures 66 can be sized to establish the desired fuel/air mixture ratio during operation of torch 10. On the inside surface of the wall 12, covering the air inlet apertures 66, is placed an air filtering media 69, illustrated as a rectangular sheet. The air filtering media can be mesh sheet material or woven or non-woven sheet material, suitable to filter out particulate from the inlet air. One air filtering media 69 covers each pair of air inlet apertures 66. In the illustrated embodiments, each of the downwardly extending members 44 of the base cap 36 include a frame that is positioned in contact with the inside surface of the upper wall 12*b*, with each frame holding one of the air filtering media 69.

Figure 11:
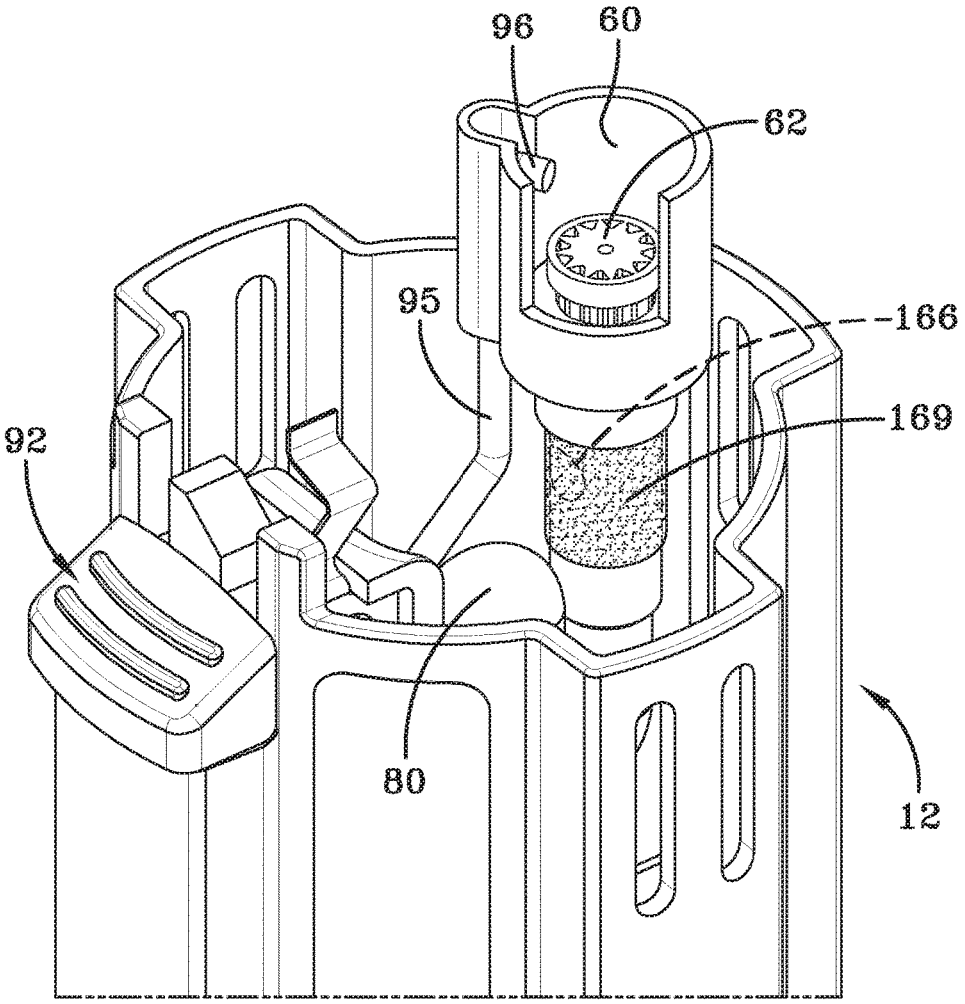
FIG. 11 is perspective view of an embodiment of a torch, detailing the microjet burner.

In an alternative embodiment of the invention, an air filtering media can be placed over an air inlet opening of the microjet burner 62. As illustrated in FIG. 11, a cylindrical sheet of filter media 169 can be positioned over and inlet air port 166 of the microjet burner 62. This embodiment enables removing particulate from the inlet air where the inlet air enters the inlet air port 166 of the microjet burner 62, negating the necessity of placing inlet air filters over each of the air inlet ports 66 in the wall 16.

As shown in FIG. 1, clip 20 can include a base 28 and a pivotable latch member 30, which can be pivotally coupled with the base 28, and can be pivotable between a closed position (FIG. 1) and an open position (not shown). A lowermost portion of body 12 can engage clip 20 in a "slip fit". For example, clip 20 can include a plurality of receptacles 32, and body 12 can include one or more protrusions 34, and each protrusion 34 can be configured for insertion into one of the receptacles 32. The clip 20 can be attached to the fuel tank 16. For example, the clip 20 can be fastened to the lower portion 26 of the fuel tank. In the illustrated embodiment, clip 20 can be fastened to the lower portion 26 of fuel tank 16 with two male fasteners 35 (FIG. 3), which can extend through the base 28 of clip 20 and can be threaded into the lower portion 26 of fuel tank 16. In other embodiments, different numbers of fasteners can be used.

The use of torch 10 can result in various advantages. When not in use, the torch 10 can be in an inactive or unarmed default configuration. In this configuration, access to an ignition button (e.g., 90) can be inhibited by the position of an ignition button guard (e.g., 150), which can be aligned with, and positioned above, an ignition button (e.g., 90). A safety cap (e.g., 38) must be rotated from a closed position to an armed position, to provide unobstructed access to an ignition button (e.g., 90). The ignition button (e.g., 90) must then be depressed to ignite torch 10. Accordingly, torch 10 can include a two-stage, child-safety ignition system—requiring rotation of the safety cap, followed by depressing of the ignition button, to reduce the likelihood of an inadvertent ignition of torch 10, for example by a child.

Use of torch 10 can result in additional advantages, for example, when used by a camper to start a campfire. Conventional lighters are typically not made for use outdoors. For example, typically they produce soft lazy flames that provide too little heat, are hard to position, and can be extinguished during windy conditions. Accordingly, starting a campfire with such conventional lighters can be difficult. In contrast, torch 10 can provide the power of a torch in a durable, compact form that can permit the user, for example a camper, to position the jet flame at any angle during use, even in windy conditions.

Torch 10 can also include a fuel fill port (e.g., 19), which can facilitate conveniently refilling torch 10 with a hydrocarbon fuel, for example butane. Torch 10 can also include a fuel tank window (e.g., 17), which can assist the user in determining the level of fuel within a fuel reservoir (e.g., 18). Torch 10 can include a clip, for example, a carabiner clip (e.g., 20), which can permit the torch 10 to be easily, and releasably, attached to a backpack or other camping accessory, to reduce the potential for misplacing or losing torch 10.

While various embodiments of a torch have been illustrated by the foregoing description and have been described in considerable detail, it is not intended to restrict or in any way limit the scope of the appended claims to such detail. Additional advantages and modifications will be readily apparent to those skilled in the art.

What is claimed is:

1. A torch including an ignition button having an ignition spring release member, the ignition button movable axially between an upper neutral position and a depressed ignition position, and a cap assembly, the cap assembly including:

a) a torsion spring including:

i) a spring coil configured to be retained on a pivot stem of the cap assembly, ii) an upper spring leg extending from the spring coil, including a down-turned tip, and iii) a lower spring leg extending from the spring coil, including an up-turned tip, b) an upper safety cap including:

i) an upper surface wall having a portal through which a torch flame can be emitted, wherein the pivot stem extends from an underside of the upper surface wall, and ii) a post body extending from the underside of the upper surface wall and having a retaining slot extending axially within the post body, the retaining slot configured to receive and capture at least an upper portion of the up-turned tip of the lower spring leg of the torsion spring, in both a first position where the lower spring leg is adjacent the base, and a second position where the lower spring leg is moved axially away from the base and into the retaining slot, and c) a lower base cap, wherein the upper safety cap is configured to be rotatably fixed to the lower base cap, including i) a base having a base surface, ii) a pair of angularly-spaced walls, including a sweep wall and a neutral wall, extending upwardly from the base and configured to retain the lower spring leg and the upper spring leg of the torsion spring, respectively, iii) a ramp disposed angularly from the sweep wall, including an inclined surface that slopes from the base to a top surface, and that faces toward the sweep wall, and a rear blocking surface, disposed opposite the ramp surface, that extends downwardly from the top surface of ramp, and that faces away from the sweep wall, wherein the base of the lower base cap has a through opening adjacent and radially outboard from the rear blocking surface of the ramp, wherein the lower spring leg of the torsion spring is configured, upon manual rotation of the upper safety cap relative to the lower base cap, to sweep along the base surface, upwardly along the inclined surface of the ramp, and downwardly from the top surface to behind rear blocking surface of the ramp, and thereby compressing the torsion spring, and wherein the ignition spring release member is disposed axially below the base of the lower base cap when the ignition button is in its depressed ignition position, and is movable upwardly through the through opening when the ignition button moves to the upper neutral position, to engage and raise the lower spring up and over the rear blocking surface to the top surface of the ramp, where the release of the manual rotation biases the lower spring leg to the sweep wall.

2. The torch of claim 1, wherein when the safety cap is in the armed position and the ignition button is in the depressed position, the piezoelectric igniter is activated and the fuel reservoir is in fluid communication with the fuel discharge passage defined by the microjet burner.

3. The torch of claim 1, wherein: the cap assembly further comprises a torsion spring; and the torsion spring biases the safety cap toward the dosed position.

4. The torch of claim 3, wherein the safety cap comprises a cylindrical, peripheral wall; the ignition button guard protrudes radially outwardly from the cylindrical, peripheral wall; and the ignition button guard is circumferentially spaced from the ignition button when the safety cap is in the armed position.

5. The torch of claim 1, wherein: the lower cap comprises a base, the base defining a bore; the safety cap comprises an upper member and a stem extending downwardly from the upper member and through the bore.

6. The torch of claim 5, wherein: the lower cap comprises a base and a platform integral with, and extending upwardly from, the base; the torsion spring comprises a coiled portion, an upper leg extending away from the coiled portion and a lower leg extending away from the coiled portion; the upper leg of the torsion spring is pressed against the platform of the lower cap; and the lower leg of the torsion spring is coupled with the safety cap and is rotatable with the safety cap.

7. The torch of claim 6, wherein: the lower cap further comprises a ramp integral with, and extending upwardly from, the base; the ramp comprises an inclined forward surface, a flat top surface and an upwardly extending rear surface; when the safety cap is rotated from the closed position to the armed position, the torsion spring is compressed, and the lower leg of the torsion spring slides along the base of the inner cap, upwardly along the inclined, forward surface of the ramp, across the top surface of the ramp, and downwardly along the rear surface of the ramp, to at least inhibit rotation of the safety cap when the safety cap is in the armed position.

8. The torch of claim 2, further comprising: a fuel flow adjustment cap, a lower, elongate member, an upper, fuel outlet valve, and a porous, compressible member; wherein the fuel flow adjustment cap is rotatable; the fuel tank comprises an upper portion and a lower portion; the upper, fuel outlet valve is threadedly connected to the upper portion of the fuel tank; the lower, elongate member extends through the lower portion of the fuel tank and is threadedly connected to the upper, fuel outlet valve; the porous, compressible member is disposed between the upper, fuel outlet valve and the lower, elongate member; and the fuel flow adjustment cap is attached to the lower elongate member, the lower elongate member being rotatable with the fuel flow adjustment cap.

9. The torch of claim 8, wherein: the upper, fuel outlet valve defines a valve passage; the porous, compressible member is in fluid communication with the fuel reservoir and is in selective fluid communication with the valve passage; when the fuel flow adjustment cap is rotated in a first direction, the porous compressible member is compressed and fluid communication between the fuel reservoir and the valve passage is at least inhibited; and when the fuel flow adjustment cap is rotated in a second direction, fluid communication between the fuel reservoir and the valve passage is facilitated.

10. The torch of claim 9, further comprising: a fuel conduit connected to the upper, fuel outlet valve and the microjet burner; the lower, elongate member comprises a needle valve; the porous, compressible member comprises a sponge; and when the upper, fuel outlet valve is in an open position, the valve passage is in fluid communication with the fuel discharge passage.

11. The torch of claim 10, further comprising: an ignition fork; wherein the ignition fork comprises a first end and a second end; the upper portion of the fuel tank comprises a fulcrum, the ignition fork being pivotable about the fulcrum; when the ignition button is in the upper position, the upper, fuel outlet valve is closed; and when the ignition button is moved from the upper position to the depressed position, the ignition button forces the first end of the ignition fork downwardly, causing the second end of the ignition fork to move upwardly and open the upper, fuel outlet valve.

12. The torch of claim 8, wherein: the upper, fuel outlet valve comprises a valve plunger and a valve housing; the valve housing defines the valve passage; the valve plunger extends into the valve passage and comprises a proximal portion in sealing engagement with the valve housing when the upper, fuel outlet valve is closed; the second end of the ignition fork forces the proximal end of the valve plunger upwardly away from the valve housing to open the upper, fuel outlet valve, as the ignition button moves downwardly toward the depressed position.

* * * * *